US005211299A

United States Patent [19]

Manfredonia

[11] Patent Number: 5,211,299

[45] Date of Patent: May 18, 1993

[54] BABY BOTTLE CAP STORAGE ORGANIZATION

[76] Inventor: Keith J. Manfredonia, 7 Bount Dr. #518, Yonkers, N.Y. 10710

[21] Appl. No.: 864,327

[22] Filed: Apr. 6, 1992

[51] Int. Cl.[5] ..... A61J 9/00; B65D 43/03

[52] U.S. Cl. ..... 215/11.1; 215/11.2; 215/11.6; 215/6; 215/10; 220/379; 206/515

[58] Field of Search ..... 215/11.1, 11.2, 11.6, 215/6, 10, 228; 220/379, 212, 23.83; 206/508, 515

[56] References Cited

U.S. PATENT DOCUMENTS

| | | | |
|---|---|---|---|
| 1,451,822 | 4/1923 | Hagerty | 215/11.1 |
| 1,563,413 | 12/1925 | Whitcomb | 220/694 X |
| 1,649,580 | 11/1927 | Geisler | 215/11.6 |
| 2,357,477 | 9/1944 | Killman | 215/11.2 X |
| 2,374,092 | 4/1945 | Glaser | 215/6 |
| 2,960,248 | 11/1960 | Kuhlman | 215/10 |
| 3,627,161 | 12/1971 | Wergeland | 215/11.6 |
| 3,682,344 | 8/1972 | Lopez | 215/11.1 |
| 4,022,060 | 5/1977 | Rebhan | 215/11.2 X |
| 4,603,784 | 8/1986 | Chang | 215/6 X |
| 4,815,615 | 3/1989 | Phlaphongphanich | 251/11.1 |
| 5,020,680 | 6/1991 | Bale | 215/11.6 |

FOREIGN PATENT DOCUMENTS

| | | | |
|---|---|---|---|
| 0061868 | 10/1982 | European Pat. Off. | 215/11.6 |
| 330424 | 7/1958 | Switzerland | 215/10 |
| 2182304 | 5/1987 | United Kingdom | 220/23.83 |

*Primary Examiner*—Allan N. Shoap
*Assistant Examiner*—Vanessa Caretto
*Attorney, Agent, or Firm*—Leon Gilden

[57] ABSTRACT

A baby bottle is formed with a truncated conical cap. The truncated conical cap includes an annular ring adjacent a top wall of the cap, and wherein the bottle portion of the organization includes a truncated conical cavity directed coaxially into the bottle from the bottom wall formed with a plurality of projections for receiving the groove therewithin for storage of the cap structure during periods of non-use.

4 Claims, 4 Drawing Sheets

BABY BOTTLE CAP STORAGE ORGANIZATION

BACKGROUND OF THE INVENTION

1. Field of the Invention

The field of invention relates to baby bottle apparatus, and more particularly pertains to a new and improved baby bottle cap storage organization wherein the same is arranged for positioning and storing of a baby bottle cap during periods of non-use to minimize loss and misplacement of such cap structure.

2. Description of the Prior Art

Baby bottle apparatus of various types are utilized throughout the prior art. Typically, a baby bottle includes a nipple structure formed with a removable cap. The removable cap is frequently misplaced during use of the bottle resultant in various inconveniences requiring the replacement of such cap organizations. The instant invention attempts to overcome deficiencies of the prior art by providing for a cap structure arranged for mounting within the bottle to prevent loss and misplacement of such cap structure.

Various prior art baby bottle apparatus is addressed in the prior art to various features such as in U.S. Pat. No. 4,934,542 to Clark wherein a baby bottle includes a nipple shield arranged for displacement overlying the nipple structure.

U.S. Pat. No. 4,940,152 to Lin sets forth a nursing bottle including a floatable suction tube arranged for accommodating fluid and its displacement within the bottle structure.

U.S. Pat. No. 4,778,068 to Kohus setting forth a plurality of stacked bottles of various capacities stacked in a coaxial aligned relationship.

As such, it may be appreciated that there continues to be a need for a new and improved baby bottle cap storage organization as set forth by the instant invention which addresses both the problems of ease of use as well as effectiveness in construction to accommodate storage of the cap structure during periods of non-use in a manner not addressed by the art and in this respect, the present invention substantially fulfills this need.

SUMMARY OF THE INVENTION

In view of the foregoing disadvantages inherent in the known types of baby bottle apparatus now present in the prior art, the present invention provides a baby bottle cap storage organization wherein the same is addressed to the storage and containment of a baby bottle cap during periods of non-use of the cap structure. As such, the general purpose of the present invention, which will be described subsequently in greater detail, is to provide a new and improved baby bottle cap storage organization which has all the advantages of the prior art baby bottle apparatus and none of the disadvantages.

To attain this, the present invention provides a baby bottle formed with a truncated conical cap. The truncated conical cap includes an annular ring adjacent a top wall of the cap, and wherein the bottle portion of the organization includes a truncated conical cavity directed coaxially into the bottle from the bottom wall formed with a plurality of projections for receiving the groove therewithin for storage of the cap structure during periods of non-use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baby bottle cap storage organization which has all the advantages of the prior art baby bottle apparatus and none of the disadvantages.

It is another object of the present invention to provide a new and improved baby bottle cap storage organization which may be easily and efficiently manufactured and marketed.

It is a further object of the present invention to provide a new and improved baby bottle cap storage organization which is of a durable and reliable construction.

An even further object of the present invention is to provide a new and improved baby bottle cap storage organization which is susceptible of a low cost of manufacture with regard to both materials and labor, and which accordingly is then susceptible of low prices of sale to the consuming public, thereby making such baby bottle cap storage organizations economically available to the buying public.

Still yet another object of the present invention is to provide a new and improved baby bottle cap storage organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operations advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
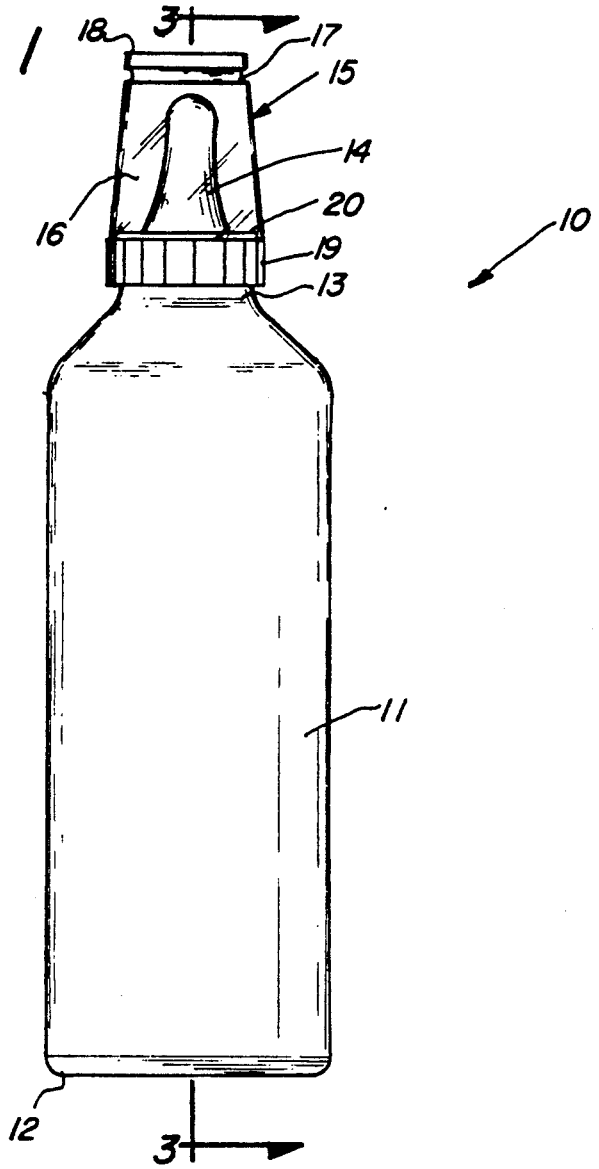
FIG. 1 is an orthographic side view of the instant invention.
Figure 2:
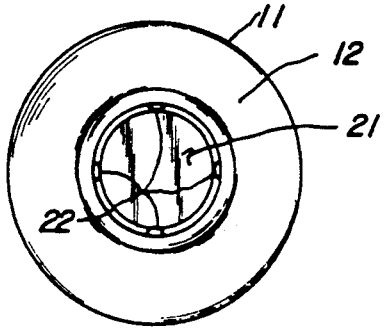
FIG. 2 is an orthographic bottom view of the instant invention.

With reference now to the drawings, and in particular to FIGS. 1 to 7 thereof, a new and improved baby bottle cap storage organization embodying the principles and concepts of the present invention and generally designated by the reference numeral 10 will be described.

Figure 3:
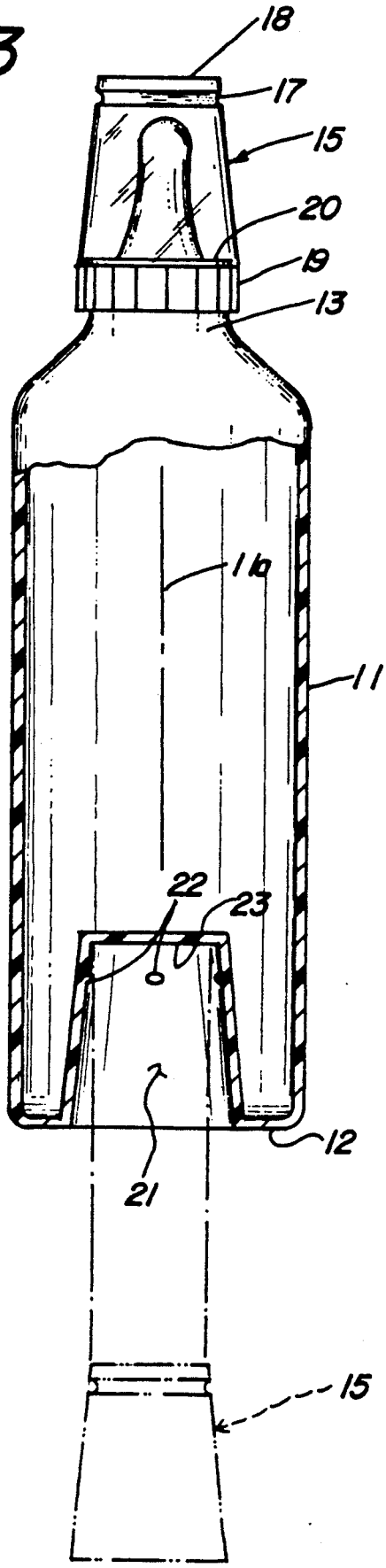
FIG. 3 is an orthographic view, taken along the lines 3—3 of FIG. 1 in the direction indicated by the arrows.

More specifically, the baby bottle cap storage organization 10 of the instant invention essentially comprises a generally cylindrical bottle member 11 defined about and elongate axis 11*a* (see FIG. 3). The bottle includes a bottle bottom wall 12 orthogonally oriented relative to the axis 11*a*, with a neck 13 coaxially aligned about the axis 11*a* at an upper portion of the bottle member 11. A nipple assembly 14 is mounted to the bottle neck 13 utilizing a nipple cap 19 formed with an annular rib 20 extending upwardly of the nipple cap concentric about the axis 11*a*. A cap member 15 includes a cap member truncated conical body 16 formed with an annular groove 17 adjacent the cap member top wall 18 spaced therefrom a predetermined spacing. The lower end of the cap member 15 is arranged for frictionally receiving the annular rib 20 therewithin for securement and temporary positioning of the cap member 15 about the nipple member in a first position.

For storage of the cap member 15, the bottom wall includes a bottom wall truncated conical cavity 21 complementarily receiving the truncated conical body 16 of the cap member 15. The conical cavity includes a conical cavity plurality of projections 22 arranged in an annular array concentric about the axis 11*a* and spaced from a cavity top wall 23 the predetermined spacing, whereupon projection of the cap member within the conical cavity 21 effects positioning of the projections 22 within the annular groove 17 for positioning of the cap member 15 within the cavity 21. It should be noted that the projections 22 are of a flexible resilient construction to permit their flexure and positioning of the projections within the groove 17 and their subsequent removal therefrom without damage to the projections during use.

Figure 4:
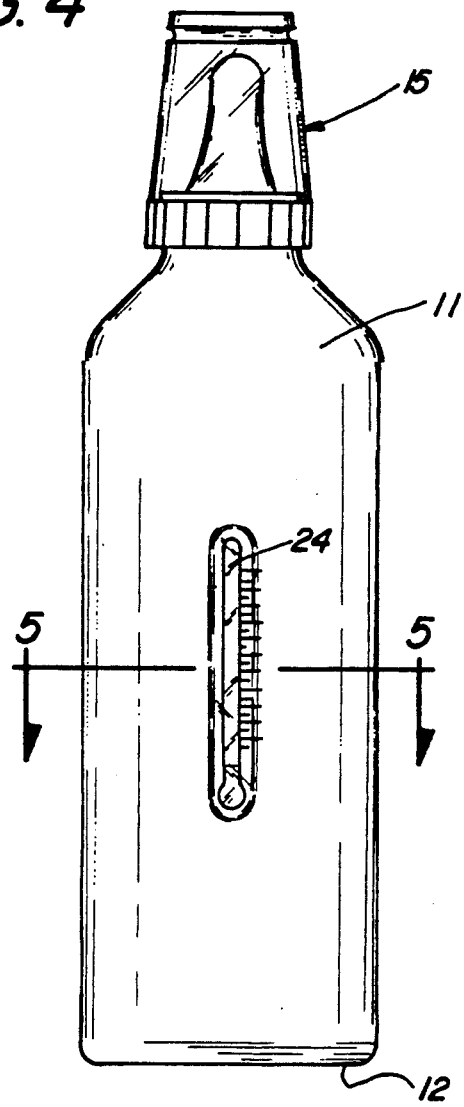
FIG. 4 is an orthographic view of the invention utilizing a thermometer mounted within the baby bottle structure.
Figure 5:
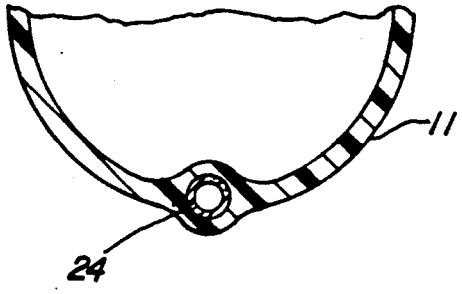
FIG. 5 is an orthographic view, taken along the lines 5—5 of FIG. 4 in the direction indicated by the arrows.
Figure 6:
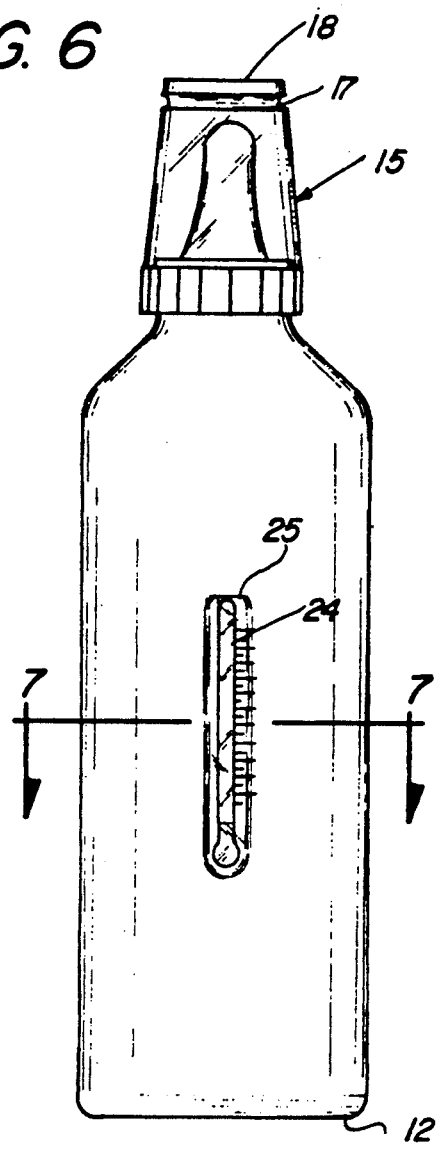
FIG. 6 is an orthographic view of the baby bottle structure utilizing a magnification lens removable mounted relative to the outer wall of the baby bottle structure.
Figure 7:
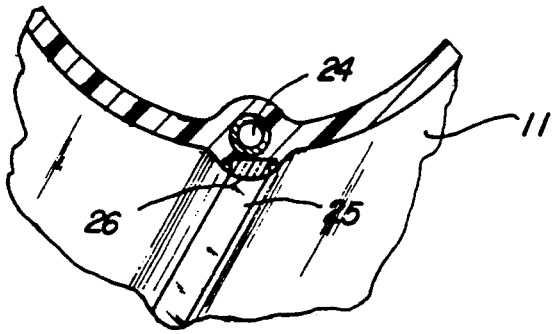
FIG. 7 is an orthographic view, taken along the lines 7—7 of FIG. 6, illustrating the magnification lens mounted within the complementarily T-shaped groove of the organization.

The apparatus, as illustrated in FIG. 4, includes a thermometer 24 mounted in a parallel relationship relative to the axis 11*a* within the wall of the bottle member 11 as the bottle member is formed of a transparent material and effects ease of reading of the thermometer 24. The FIGS. 6 and 7 further illustrate the use of a transparent T-shaped magnification lens 25 slidable mounted in a parallel coextensive relationship relative to the thermometer 24 within a complementarily configured T-shaped groove 26 directed through the wall of the bottle member 11 forwardly of the thermometer 24 for ease of reading of the thermometer during use. The magnification lens 25 is readily removed relative to the T-shaped groove for cleaning of the magnification lens as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A baby bottle cap storage organization, comprising, a generally cylindrical bottle member formed about an axis, wherein the bottle member includes a bottom wall at a lower distal end of the bottle member, with the bottom wall orthogonally oriented relative to the axis, and a neck at an upper end of the bottle member spaced from the bottom wall coaxially aligned about the axis, and a nipple cap mounted to the neck, with the nipple cap including a nipple member mounted within the cap, and the nipple cap including an annular rib projecting upwardly of the nipple cap coaxially aligned about the axis, and a cap member having a truncated conical body including a planar top wall and a lower entrance, with the lower entrance frictionally receiving the annular rib therewithin, and the cap member includes an annular groove spaced from the cap member bottom top wall a predetermined spacing, and the bottle member wall includes a truncated conical cavity directed into the bottle member coaxially aligned relative to the axis extending from the bottom wall, wherein the truncated conical cavity complementarily receives the truncated conical body of the cap member therewithin.

2. An organization as set forth in claim 1 wherein the conical cavity includes a conical cavity top wall parallel relative to the bottom wall, and a plurality of flexible resilient projections formed within the conical cavity projecting into the conical cavity and spaced from the cavity top wall the predetermined spacing for reception within the annular groove when the cap member is directed into the conical cavity.

3. An organization as set forth in claim 2 wherein the bottle member includes a bottle member cylindrical wall and the cylindrical wall includes a thermometer mounted within the cylindrical wall arranged parallel relative to the axis.

4. An organization as set forth in claim 3 wherein the cylindrical wall includes an elongate groove of a generally T-shape cross-sectional configuration, and a transparent magnification lens slidably mounted within the T-shaped groove, the T-shaped groove positioned adjacent to and forwardly of the thermometer to effect magnification of the thermometer.

* * * * *